US012760476B2

(12) United States Patent
Kauppinen et al.

(10) Patent No.: US 12,760,476 B2
(45) Date of Patent: Oct. 13, 2026

(54) SYSTEM FOR IMPROVED POSITIONING OF ROAD CONSTRUCTION MACHINES

(71) Applicant: LEICA GEOSYSTEMS AG, Heerbrugg (CH)

(72) Inventors: Tommi Juhani Kauppinen, Odense C (DK); Jürgen Seemann, Hatten (DE); Magnus Thibblin, Odense C (DK); Burkhard Böckem, Jonen AG (CH)

(73) Assignee: LEICA GEOSYSTEMS AG, Heerbrugg (CH)

( * ) Notice: Subject to any disclaimer, the term of this patent is extended or adjusted under 35 U.S.C. 154(b) by 161 days.

(21) Appl. No.: 18/383,403

(22) Filed: Oct. 24, 2023

(65) Prior Publication Data

US 2024/0133129 A1 Apr. 25, 2024
US 2024/0229371 A9 Jul. 11, 2024

(30) Foreign Application Priority Data

Oct. 24, 2022 (EP) ..... 22203414

(51) Int. Cl.
*E01C 19/00* (2006.01)

(52) U.S. Cl.
CPC ..... *E01C 19/004* (2013.01)

(58) Field of Classification Search
None
See application file for complete search history.

(56) References Cited

U.S. PATENT DOCUMENTS

2014/0046589 A1* 2/2014 Metzler ..... G05D 1/646 356/3.09
2016/0160452 A1* 6/2016 Orefice ..... E01C 23/01 701/50
2019/0114911 A1* 4/2019 Rezaei ..... G08G 1/164
2020/0018605 A1* 1/2020 Kusano ..... G06V 20/56
2020/0122540 A1 4/2020 Rife, Jr. et al.
2020/0225026 A1* 7/2020 Hoegele ..... G01B 11/005
2021/0224589 A1* 7/2021 Jahagirdar ..... G06F 18/28
2021/0254308 A1* 8/2021 Thibblin ..... E02F 9/2087

(Continued)

FOREIGN PATENT DOCUMENTS

EP 3 795 748 A1 3/2021
EP 3 865 895 A1 8/2021

OTHER PUBLICATIONS

Extended European Search Report dated Apr. 3, 2023 as received in Application No. 22203414.2.

*Primary Examiner* — Abdulmajeed Aziz
(74) *Attorney, Agent, or Firm* — Maschoff Brennan

(57) ABSTRACT

A system for positioning of a road construction machine of the type paver. The system comprises a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, and several markers. The system further comprises a data memory, wherein the data memory has stored a 3D design model referenced with respect to a 3D construction site coordinate system and information about a known absolute reference of the several markers in the 3D construction site coordinate system, and a computing unit.

15 Claims, 4 Drawing Sheets

(56) References Cited

U.S. PATENT DOCUMENTS

| | | | | |
|---|---|---|---|---|
| 2022/0011102 | A1* | 1/2022 | Yamamoto | G01C 21/165 |
| 2022/0056669 | A1* | 2/2022 | Tamasato | G01C 11/06 |
| 2022/0234603 | A1* | 7/2022 | Mujumdar | B60W 40/09 |
| 2023/0064401 | A1* | 3/2023 | Heinzle | G01S 17/86 |

* cited by examiner

SYSTEM FOR IMPROVED POSITIONING OF ROAD CONSTRUCTION MACHINES

FIELD

The present disclosure relates to a system for positioning of a road construction machine of the type paver, in particular asphalt paver or concrete paver, or milling machine, in particular trimmer, surface miner, recycler or soil stabilizer, the system comprises a first measuring unit, several markers, a data memory and a computing unit.

BACKGROUND

There are various measuring systems known for the specific needs in the field of construction. Such measuring systems can be used with a construction machine for example to: (a) build a digital 3D model of the surroundings of the machine, (b) detect obstacles in the surroundings of the machine, and/or (c) support a control of the construction machine.

For example, EP 3 865 895 A1 shows a construction machine, in particular a grader, a dozer, or an excavator, with a measuring system having a measuring unit that is configured for generating measuring data in a detection range and comprises at least a camera and a LiDAR scanner. The system also has a computer which is configured for generating a three-dimensional model of the terrain within the detection range, identifying an obstacle or a person within the detection range and controlling the steering of the construction machine.

However, such prior art measuring systems have the disadvantage that they cannot be used to accurately determine the position of the construction machine on the construction site, in particular when the construction machine is continuously moving.

In the field of road construction, especially in the field of road paving or removing the road surface, so-called paver, in particular asphalt paver or concrete paver, or miller are used. For a correct and time-efficient paving or milling by means of such a road construction machine, it is of great importance that the position and thus also the already covered path of the road construction machine can be determined very accurately. In this way, it is ensured that the areas that have already been paved or milled are not paved or milled again, that some areas are not paved or milled (left out/missed), or that the paved or milled area corresponds to the previously determined planning of the construction management.

The traditional setup for 3D positioning and control of road construction machines such as paver or miller includes multiple total stations which are arranged with known position around the road construction machine. Targets/markers, e.g. retroreflectors, are attached to the road construction machine, wherein the total stations determine the distance and the angle to the assigned moving target/marker to identify the accurate x/y/z position. Based on the known position of the total stations and the distances/angles to the targets, the positions/poses of the targets and consequently the position/pose of the road construction machine in the construction site can be determined. Common systems require four total stations around the road construction machine for distance determination and another total station for quality assurance purposes.

As the road construction machine is constantly moving during the paving or milling process, the total stations must be moved along with the road construction machine in order to keep the sensors within range of the targets/markers and thus ensure accurate measurement. Further, the total stations must be repositioned at the appropriate positions. At these positions, the exact position of the total station must then be remeasured and referenced. On the one hand, this causes a complex and time-consuming setup and, on the other hand, involves potential error sources, since measurement inaccuracies can occur when determining the position of the total station and referencing, especially due to human error.

Hence, there is a need to develop systems for improved and simplified positioning and controlling of road construction machines of the type paver, in particular asphalt paver or concrete paver, or milling machines, in particular trimmer, surface miner, recycler or soil stabilizer, on a construction site.

It is therefore an object of the disclosure to provide a system for improved and simplified positioning and controlling of road construction machines of the type paver, in particular asphalt paver or concrete paver, or milling machines, in particular trimmer, surface miner, recycler or soil stabilizer, on a construction site.

SUMMARY

The present disclosure relates to a system for positioning of a road construction machine of the type paver, in particular asphalt paver or concrete paver, or milling machine, in particular trimmer, surface miner, recycler or soil stabilizer, the system comprises a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, and several markers. For example, the minimum repetition rate for the camera is at least 20 Hz, in particular at least 50 Hz, more particularly 100-130 Hz. For example, regarding the LiDAR module, a 3D point cloud is generated at a rate of at least one sample point of the 3D point cloud per second per angular field of view of half a degree in elevation by one degree in azimuth (point acquisition rate of at least 150'000 points per second). The system further comprises a data memory, wherein the data memory has stored a 3D design model referenced with respect to a 3D construction site coordinate system and information about a known absolute reference of the several markers in the 3D construction site coordinate system, and a computing unit. The computing unit is configured for identification of the several markers within the first measuring data and determination of relative positions of the several markers within the first detection range within the first measuring data, determination of a pose of the first measuring unit and therewith the pose, particularly in six degrees of freedom, of the road construction machine in the 3D construction site coordinate system based on the determined relative positions of the several markers and the stored information about the known absolute reference of the several markers and deriving steering commands (steering commands are not only commands that control the motion of the road construction machine, but commands that control all possible functions/movements/operations of the road construction machine) for the road construction machine so as to work in accordance with the 3D design model.

This disclosure has the advantage over prior art systems that the pose of the road construction machine in the 3D construction site coordinate system is determined by detecting already referenced markers that have been set up on the construction site by means of a measuring unit mounted on the road construction machine. This allows a simplified positioning of the road construction machine and makes the system much less susceptible to errors, since the position is not determined as in the prior art by targeting markers on the road construction machine using several total stations set up on the construction site, which have to be constantly repositioned and referenced, especially with a moving road construction machine.

In a further embodiment, the system, in particular the first measuring unit, further comprising, in order to facilitate an accurate determination of the pose of the first measuring unit, at least one positioning unit known to the skilled person, for example a GNSS receiver, an IMU or a compass.

In a further embodiment, the first LiDAR sensor module is configured for rotating a first measuring beam around a first axis and around a second axis nonparallel to the first axis with a rotating speed of at least 0.5 Hz with respect to each axis (for example, wherein the first measuring beam is emitted as pulsed laser beam, e.g. wherein the pulsed laser beam comprises 1.2 million pulses per second) and comprises a base, a support, mounted on the base and being rotatable relative to the base, and a deflector for deflecting the first measuring beam and returning parts of the measurement beam, the deflector being mounted on the support and being rotatable relative to the support. The first LiDAR sensor module is further configured for continuously rotating the support relative to the base around the first axis, in particular with a rotating speed of 1 Hz, and continuously rotating the deflector relative to the support around the second axis, in particular with a rotating speed of 50 Hz and comprises an angle encoder unit configured for determining angle data representing an orientation of the first measuring beam relative to the first and second axes. In particular, the first LiDAR sensor module is configured to have a field-of-view of 360 degrees about the first axis and 130 degrees about the second axis, and to generate data with a point acquisition rate of at least 150'000 points per second.

In a further embodiment, the first LiDAR sensor module comprises at least two time-of-flight cameras, wherein each time-of-flight camera comprises a sensor array and one or more laser emitters. The sensor array of each of the time-of-flight cameras has an optical axis and is configured to receive reflections of light pulses emitted by the one or more laser emitters of the respective time-of-flight camera and the at least two time-of-flight cameras are arranged around a third axis so that each sensor array has one or two other sensor arrays as a neighbouring sensor array, wherein no angle about the third axis between the optical axes of a sensor array and one of its neighbouring sensor arrays is larger than 360° n+20°, where n is the number of time-of-flight cameras arranged around the third axis.

In a further embodiment, in the course of generating the first measuring data two-dimensional image data of the first detection range are captured continuously by the at least first camera and three-dimensional point-cloud data of the first detection range are captured continuously with the first LiDAR sensor module. The first measuring unit is configured to link the captured image data and point-cloud data to the pose at which they are captured.

In a further embodiment, the computing unit is configured to identify an obstacle or a person within the first detection range, based on the two-dimensional image data and/or on the three-dimensional point-cloud data, in particular wherein the obstacle identification is carried out by Template Matching. This embodiment allows workers to safely operate on the construction site and also protects expensive vehicles and equipment from being hit and destroyed by the road construction machine.

In a further embodiment, the computing unit is configured to execute a SLAM functionality using the two-dimensional image data and/or the three-dimensional point-cloud data for simultaneous localization and mapping, and/or a pose and trajectory determination functionality for continuously determining a pose and a trajectory of the first measuring unit based on the two-dimensional image data and/or on the three-dimensional point-cloud data.

In other words, imaging laser scanner technology (camera and LiDAR sensor module) and a corresponding evaluation (positioning) algorithm are applied together with real-time registration to achieve sufficient 3D position accuracy for paving applications. The first measuring sensor uses camera technology to locate pre-surveyed markers for on-line registration for enhancing positioning. The positioning algorithm is running in the sensor (first measuring unit), as-well as any other real-time or near real-time computing routine (edge processing).

In a further embodiment, in the course of generating the first measuring data the computing unit is configured to continuously generate localization data while the first measuring unit is moved and to track the pose of the first measuring unit and therewith the pose of the road construction machine based on the localization data, particularly in 6 degrees of freedom.

In a further embodiment, as the road construction machine and thus also the first detection range moves forward in accordance with the 3D design model, several further markers, which have not been identified within the first measuring data so far, appear in the first detection range. The computing unit is configured for identification of the several further markers and some still identified markers of the several markers within the first measuring data and determination of relative positions of the several further markers within the moved first detection range within the first measuring data and deriving information about a known absolute reference of the several further markers in the 3D construction site coordinate system as new absolute reference in the 3D construction site coordinate system and storing the new absolute reference as new information in the data memory. The step of determination of the pose of the first measuring unit and therewith the pose of the road construction machine in the 3D construction site coordinate system is further based on the determined relative positions of the several further markers and the stored new information about the known new absolute reference.

In a further embodiment, the first measuring unit is arranged at a first location of the road construction machine and the system further comprises a second measuring unit arranged at a second location of the road construction machine. The second measuring unit is configured for generating second measuring data in a second detection range and comprising at least a second camera and a second LiDAR sensor module. A relative position, in particular a relative pose, between the first and second measuring unit is predetermined or determinable, wherein the computing unit is configured for generating combined measuring data based on the first measuring data, the second measuring data, and a current relative position, in particular a current relative pose, between the first and second measuring unit. This embodiment has the advantage that by using this combined measurement data, the computing unit determines the pose of the road construction machine in the 3D construction site coordinate system with an increased accuracy compared to embodiments with only one (the first) measuring unit.

In a further embodiment, at least one of the first and second measuring units is used to generate measuring data and thus to determine the pose of the road construction machine, wherein the selection which of the (first or second) measuring units is used to generate measuring data is made based on which measuring unit identifies the several markers most accurately and/or most conveniently. The (first or second) measuring unit, which (at the moment) does not generate any measuring data, is in a stand-by mode and can be switched on/activated by the computing unit at any time, as soon as either the several markers are no longer detected by the currently active (first or second) measuring unit or if the accuracy is no longer sufficient and this has to be increased by using both measuring units. This embodiment has the advantage that by switching from the first to the second measuring unit or vice versa, or by activating both measuring units, on the one hand the system can be used very flexibly and can react to eventualities that can occur on a construction site (e.g. impassable terrain, weather influences, constrictions, etc.) and, on the other hand, sufficient accuracy is always guaranteed for position determination.

In other words, the positioning solution requires at least one measuring unit on the machine, or multiple ones depending on the size of the machine, to be able to have an uninterrupted field of view to the pre-surveyed markers and/or known features.

In a further embodiment, the second measuring unit and/or a further (third) measuring unit is configured to be attached to a rear of the road construction machine (paver/miller) wherein, the second measuring unit and/or the further (third) measuring unit at the rear collects as-built data (while the road construction machine is still in operation), in particular including surface temperature, moisture content, or the grade/slope of the pavement and thus monitors the progress and/or the quality of the paving/milling (quality assurance).

In a further embodiment, the several markers and the several further markers are retroreflectors, in particular wherein the retroreflectors are configured as at least one of at least one triple prism, at least one spherical reflector, retroreflective foil, in particular reflective target mark, and Microprism array, in particular consisting of plastic or glass.

In a further embodiment, the several markers and the several further markers are prominent features/objects in a construction site, in particular prominent features/objects such as trees, rocks, poles, buildings. This embodiment has the advantage that no extra markers/targets have to be set up on the construction site, but that it is possible to work with already existing features/objects, which are then referenced.

In a further embodiment, the system further comprising two GNSS receivers for receiving signals from navigation satellites positioned on the road construction machine fixed and in known relationship with respect to one another, in particular wherein the first measuring unit is arranged on the road construction machine in a predefined position with respect to the GNSS receivers, and the computing unit is configured for using the signals to generate direction vectors and for deriving the steering commands for the road construction machine so as to work in accordance with the 3D design model based on the direction vectors.

In a further embodiment, the system further comprising several mobile markers configured to be attached to at least one vehicle at known positions, wherein the at least one vehicle is moving ahead and/or behind the road construction machine, such that the several mobile markers are within one of the first or further detection ranges of the first or further (second or third) measuring units, and a sending unit configured to send steering commands to the at least one vehicle such that the road construction machine and the at least one vehicle being capable of travelling in formation, wherein the computing unit is configured for

- identification of the several mobile markers within one of the first or further measuring data and determination of relative positions of the several mobile markers within one of the first or further detection ranges within the first or further measuring data,
- determination of a pose, particularly in six degrees of freedom, of the at least one vehicle in the 3D construction site coordinate system based on the determined relative positions of the several mobile markers and the pose of one of the first or further (second or third) measuring units,
- deriving further steering commands for the at least one vehicle so as to work in accordance with the 3D design model,
- transmitting the further steering commands to the sending unit.

As an example of such a paving train, a slipform or asphalt paver (first vehicle) drives in front of the road construction machine/main paver, places the material (e.g. concrete or asphalt) and brings it into a desired shape, i.e. applies a first layer. The main paver places further material (e.g. concrete or asphalt) on the first layer and also brings it into the desired shape, i.e. applies a second layer. A following vibratory roller (e.g. can be used on soil or asphalt) (second vehicle) consolidates the material (first and second layer). This second vehicle could be one or several rollers compacting the pavement. The computing unit of the system would use the relative position of each second vehicle by means of steering commands for collision avoidance and proper copaction control. In another example of a paving train, a texturing machine (further vehicle) could also be positioned at a certain position of the paving train or replace a vehicle of the paving train. However, any other constellation of pavers or other road construction machines for the creation of such a paving train is conceivable.

The use of a prior art system for determining the position of road construction machines/vehicles (e.g. pavers), which uses markers/targets (e.g. retroreflectors) mounted on the road construction machines and targeted with total stations which are set up on the construction site, is particularly disadvantageous for such a paving train, as a large number of total stations has to be set up on the construction site and each road construction machine has to be targeted individually. In this case, on the one hand, the probability that an error occurs when referencing the total stations or when targeting the road construction machines individually is very high and, on the other hand, the mobility, especially for large vehicles, on the construction site is severely restricted due to the large number of total stations set up. The use of the present disclosure for determining the position of the vehicles of such a paving train offers the great advantage that, since targets/markers are attached to the road construction machines (vehicles) and are detected by one of the first or further (second or third) measuring units on the main paver, the position of the other vehicles of the paving train is determined based on the determined position of one of the first or further (second or third) measuring units. The position of one of the first or further measuring units is determined as already described based on the determined relative positions of the several (further) markers and the stored information about the known absolute reference of the several (further) markers. Consequently, the positions of all road construction machines/vehicles of the paving train can be determined without the errors of setting up a large number of total stations and without the need to set up more markers than if only the position of the main paver is determined for the individual application. This particular embodiment also facilitates the controlling of the vehicles on the construction site by sending corresponding steering commands to the individual vehicles of the paving train based on the position determination, such that the main paver and the other paving train vehicles drives independently of one another and travel in formation.

A further possible application for the system is the continuously reinforced concrete pavement (CRCP) construction.

BRIEF DESCRIPTION OF THE DRAWINGS

Aspects are illustrated in more detail below, purely by way of example, with reference to working examples shown schematically in the drawing. Identical elements are labelled with the same reference numerals in the figures. The described embodiments are generally not shown true to scale and they are also not to be interpreted as limiting.

DETAILED DESCRIPTION

Figure 1:
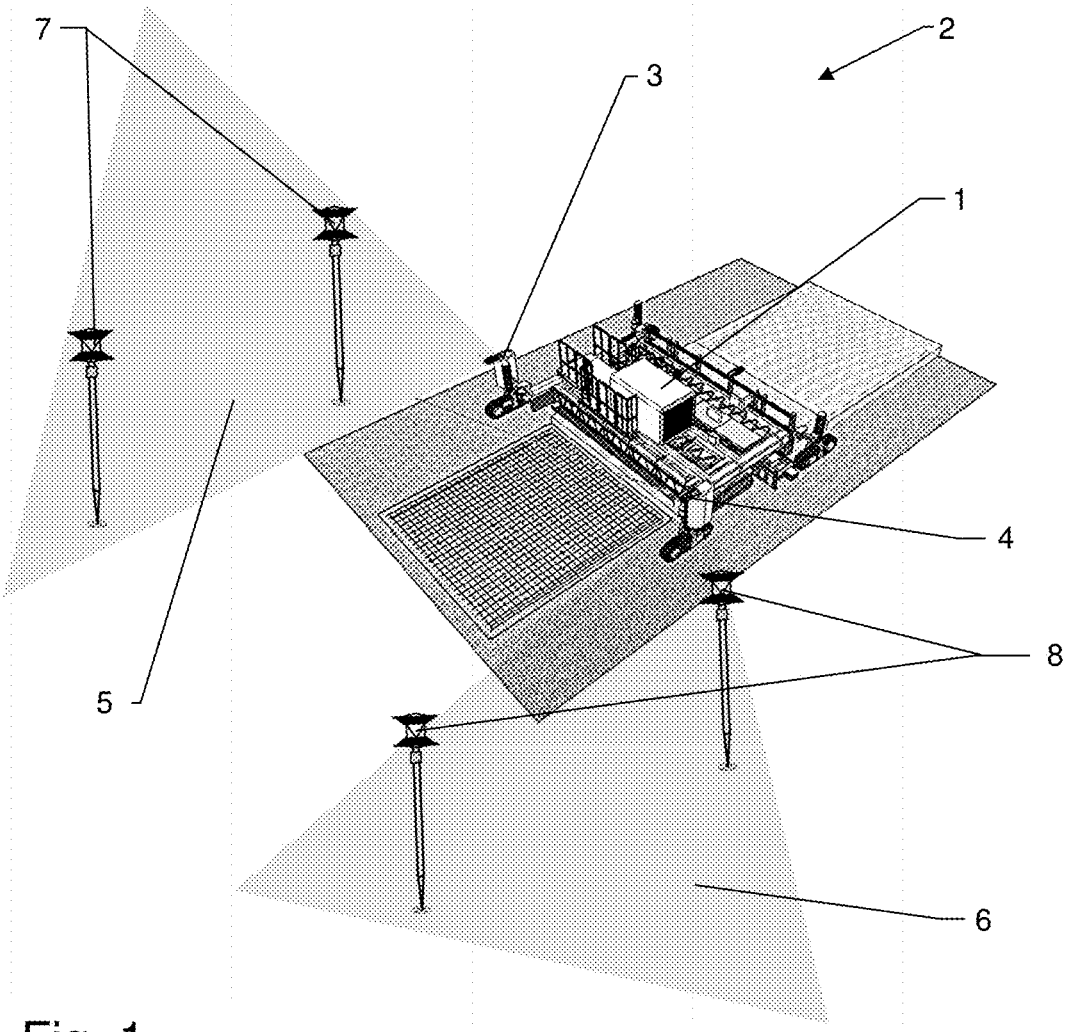
FIG. 1 shows a paver equipped with the system, wherein the system comprises a first and a second measuring unit in the front.

FIG. 1 shows a schematic illustration of a road construction machine 1 of the type paver, equipped with the system 2. The system 2 comprises a first measuring unit 3 arranged at a first location (in the front) and a second measuring unit 4 arranged at a second location (in the front) of the road construction machine 1. The first measuring unit 3 generates first measuring data in a first detection range 5 during a movement of the road construction machine 1 and comprises at least a first camera and a first LiDAR sensor module. The second measuring unit 4 generates second measuring data in a second detection range 6 during the movement of the road construction machine 1 and comprises at least a second camera and a second LiDAR sensor module. The system 2 further comprises several targets/markers 7 (in this particular example retroreflectors attached to poles), a data memory, wherein the data memory has stored a 3D design model referenced with respect to a 3D construction site coordinate system and information about a known absolute reference of the several markers 7 in the 3D construction site coordinate system, and a computing unit.

Figure 2:
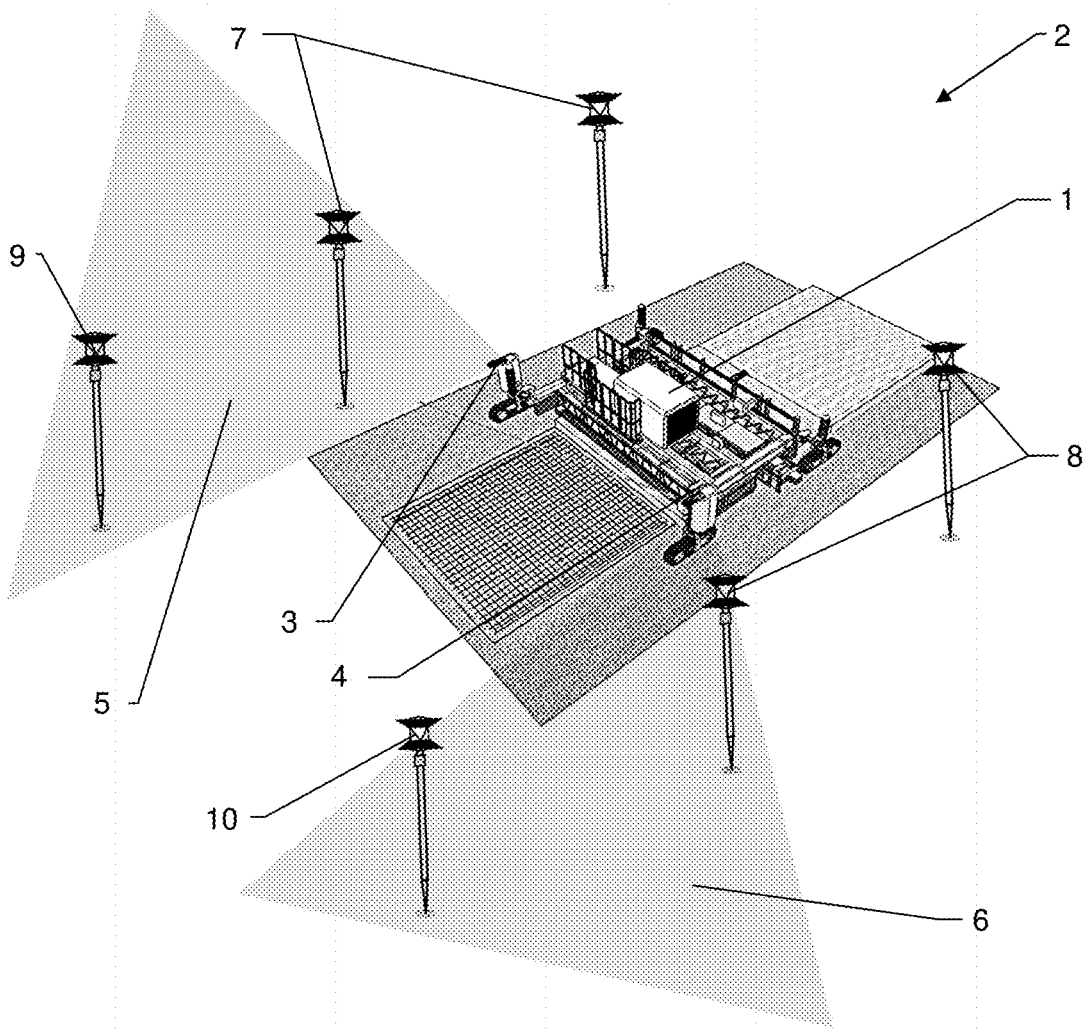
FIG. 2 shows a schematic illustration of the positioning of a paver by a floating process.
Figure 3:
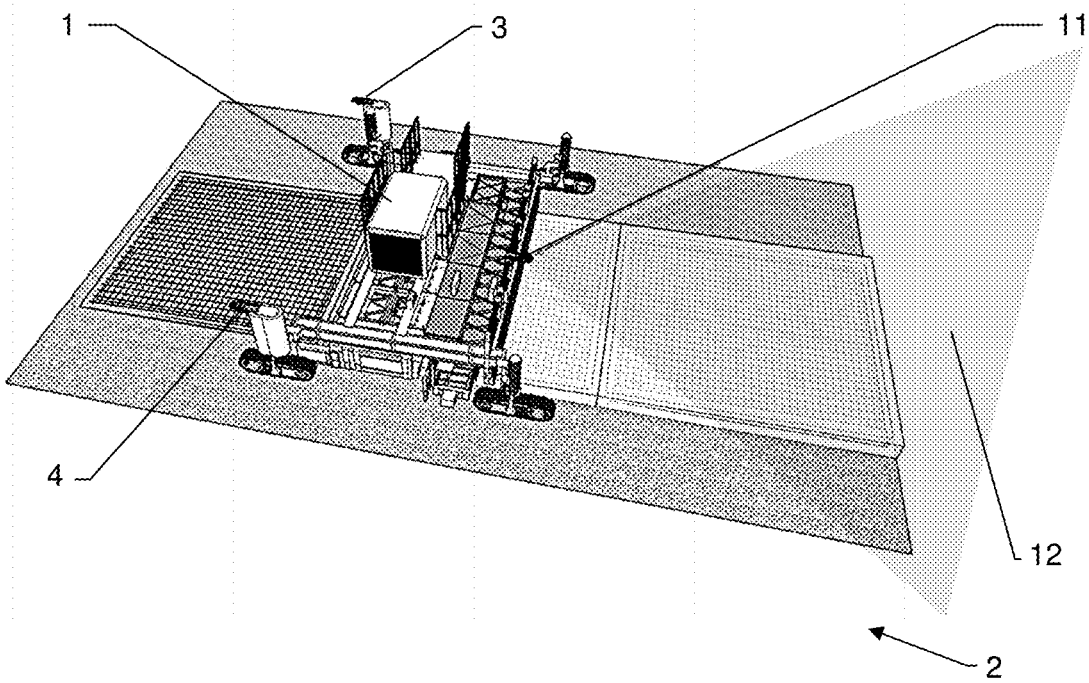
FIG. 3 shows a paver equipped with the system, wherein the system comprises a further measuring unit in the rear.

The detection ranges illustrated in FIGS. 1-3 (for example, the first and second detection ranges 5,6 in FIG. 1) are merely exemplary/illustrative ranges. Depending on the type, configuration and/or arrangement of the (first and second) measuring units, the (first and second) detection ranges can be extended accordingly and, under specific circumstances, enable 360° detection in all three dimensions. The locations at which the (first and second) measuring units are attached on the road construction machine 1 can also vary. It is important that the (first and second) detection ranges cover such an area that several markers can be detected in time and with a sufficiently high accuracy.

The computing unit identifies the several markers 7 within the first measuring data and determines the relative position of the several markers 7 within the first detection range 5 within the first measuring data. Then the computing unit determines a pose of the first measuring unit 3 and therewith the pose, particularly in six degrees of freedom, of the road construction machine 1 in the 3D construction site coordinate system based on the determined relative positions of the several markers 7 and the stored information about the known absolute reference of the several markers 7. Finally, the computing unit derives steering commands for the road construction machine 1 so as to work in accordance with the 3D design model (this ensures that the progress of the work/treatment of the ground is carried out according to the planning of the construction/project management).

In the advantageous embodiment shown in FIG. 1, the computing unit further identifies the several markers 8 within the second measuring data and determines the relative positions of the several markers 8 within the second detection range 6 within the second measuring data. A relative position, in particular a relative pose, between the first and second measuring unit 3,4 is determined, wherein the computing unit generates combined measuring data based on the first measuring data, the second measuring data, and a current relative position, in particular a current relative pose, between the first and second measuring unit 3,4.

Using this combined measurement data, the computing unit determines the pose of the road construction machine 1 in the 3D construction site coordinate system based on the determined relative positions of the several markers 7,8 and the stored information about the known absolute reference of the several markers 7,8 with an increased accuracy compared to the embodiment with only the first measuring unit 3.

By way of example, the forward-facing first and second measuring units 3,4 can be further used to collect data on rebar positioning and orientation enabling further data for contractors as additional quality assurance means. The data can also include base layer surface data, again for quality assurance purposes, enabling comparisons of data from different contractors by the end customer, thus enabling a true life of a road data collection and visualization.

FIG. 2 shows a schematic illustration of the positioning of the construction machine 1 (concrete paver) by a floating process. When the road construction machine 1 and thus also the first detection range 5 moves forward in accordance with the 3D design model, a further marker 9, which has not been identified within the first measuring data so far, appear in the first detection range 5. In a next step, the computing unit identifies the further marker 9 and the still identified marker of the several markers 7 within the first measuring data and determines the relative position of the further marker 9 within the moved first detection range 5 within the first measuring data. The computing unit then derives information about a known absolute reference (in this example the still identified marker of the several markers 7 within the first measuring data) of the further marker 9 in the 3D construction site coordinate system as new absolute reference in the 3D construction site coordinate system and stores the new absolute reference as new information in the data memory. The step of determination of the pose of the first measuring unit 3 and therewith the pose of the road construction machine 1 in the 3D construction site coordinate system is based on the determined relative position of the further marker 9 and the stored new information about the known new absolute reference. Finally, the computing unit derives steering commands for the road construction machine so as to work in accordance with the 3D design model based on the determined position of the road construction machine 1 by the described floating process.

In this way, a continuous determination of the pose of the road construction machine 1, a continuous comparison of the covered path with the 3D design model and a continuous control of the road construction machine 1 in accordance with the 3D design model is provided without having to interrupt the paving or milling process. Instead, markers 7 that have disappeared from the field of view 5 of the first measuring unit 3 and can therefore no longer be used as a known absolute reference of the further marker 9 can be set up again in the field of view 5 of the first measuring unit 3. In addition to maintaining the continuous work process (paving/milling), this also facilitates/simplifies positioning of the road construction machine 1 with a few markers. In systems according to prior art, total stations for determining the position of the road construction machine have to be constantly removed and set up again at another location due to the movement of the machine, wherein inaccuracies/errors can occur during the set-up and subsequent referencing of the total stations, which can lead to errors in the determination of the position. Instead, the system 2 enables a simplified, continuous determination of the position of the road construction machine 1 with reduced sources of error and significantly less work and material resources.

In the advantageous embodiment shown in FIG. 2, based on the movement of the road construction machine 1 the second detection range 6 moves also forward which results in a further marker 10, which has not been identified within the second measuring data so far, appearing in the second detection range 6. The computing unit identifies the further marker 10 and the still identified marker of the several markers 8 within the second measuring data and determines the relative position of the further marker 10 within the moved second detection range 6 within the second measuring data. The computing unit then derives information about a known absolute reference (in this example the still identified marker of the several markers 8 within the second measuring data) of the further marker 10 in the 3D construction site coordinate system as new absolute reference in the 3D construction site coordinate system and stores the new absolute reference as new information in the data memory.

Based on the determined relative position of the further marker 10 and the stored new information about the known new absolute reference the computing unit determines the pose of the second measuring unit 4. In a next step, the relative position, in particular the relative pose, between the first and second measuring unit 3,4 is determined, wherein the computing unit generates combined measuring data based on the first measuring data, the second measuring data, and a current relative position, in particular a current relative pose, between the first and second measuring unit 3,4. Using this combined measurement data, the computing unit determines the pose of the road construction machine 1 in the 3D construction site coordinate system with an increased accuracy compared to the embodiment with only the first measuring unit 3.

FIG. 3 shows the road construction machine 1 (paver) equipped with the system 2, wherein the system 2 comprises a further (third) measuring unit (sensor) 11 in the rear. The further (third) measuring unit at the rear collects as-built data (while the road construction machine is still in operation), in particular including surface temperature, moisture content, position of the pavement, or the grade/slope of the pavement, and thus monitors the progress and/or the quality of the paving/milling (quality assurance) in the further (third) detection range 12.

Figure 4:
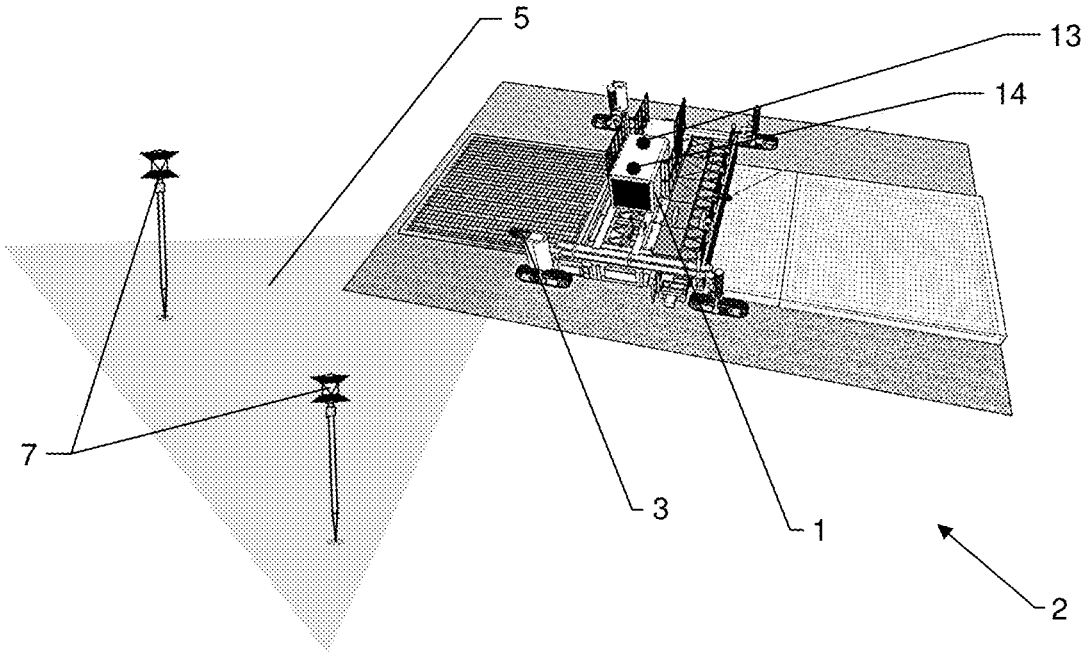
FIG. 4 shows a paver equipped with the system, wherein the system further comprises two GNSS receivers.

FIG. 4 shows the road construction machine 1 (paver) equipped with the system 2, wherein the system 2 comprises in this example only the first measuring unit 3 and further comprises two GNSS receivers 13,14. The two GNSS receivers 13,14 are positioned on the paver 1 fixed and in known relationship with respect to one another and receive signals from navigation satellites, wherein the first measuring unit 3 is arranged on the paver 1 in a predefined position with respect to the GNSS receivers 13,14. The computing unit uses the signals to generate direction vectors and for deriving the steering commands for the paver 1 so as to work in accordance with the 3D design model based on the direction vectors. For deriving the steering commands, the computing unit further uses the determined pose of the paver 1 in the 3D construction site coordinate system based on the determined relative positions of the several markers 7 and the stored information about the known absolute reference of the several markers 7 and puts it in relation to the direction vectors. In other words, the paver 1 is equipped with only one (the first) measuring unit 3 which is used for position/pose determination and the two GNSS units 13,14 which are used for heading control. This would be a set up for paver or milling machines with narrow paving width in which it is not needed to monitor both sides (the one measuring unit 3 only monitors one side of the paver 1 and identifies the markers 7 that are on that side and not both sides, as it would be in a setup with two (first and second) measuring units 3,4). However, an embodiment with additional (e.g. second and/or third) measuring units combined with the two GNSS receivers is also conceivable.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A system for positioning of a road construction machine of the type paver, or milling machine, surface miner, recycler or soil stabilizer, the system comprises:

a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, several markers, a data memory, wherein the data memory has stored:

a 3D design model referenced with respect to a 3D construction site coordinate system, and information about a known absolute reference of the several markers in the 3D construction site coordinate system, a computing unit, wherein the computing unit is configured for:

identification of the several markers within the first measuring data and determination of relative positions of the several markers within the first detection range within the first measuring data, determination of a pose of the first measuring unit and therewith the pose, particularly in six degrees of freedom, of the road construction machine in the 3D construction site coordinate system based on the determined relative positions of the several markers and the stored information about the known absolute reference of the several markers, and deriving steering commands for the road construction machine so as to work in accordance with the 3D design model, wherein the first LiDAR sensor module comprises at least two time-of-flight cameras, wherein:

each time-of-flight camera comprises a sensor array and one or more laser emitters, the sensor array of each of the time-of-flight cameras has an optical axis and is configured to receive reflections of light pulses emitted by the one or more laser emitters of the respective time-of-flight camera, and the at least two time-of-flight cameras are arranged around a third axis so that each sensor array has one or two other sensor arrays as a neighboring sensor array, wherein no angle about the third axis between the optical axes of a sensor array and one of its neighboring sensor arrays is larger than 360°n+20°, where n is the number of time-of-flight cameras arranged around the third axis.

2. The system according to claim 1, wherein the first LiDAR sensor module:

is configured for rotating a first measuring beam around a first axis and around a second axis nonparallel to the first axis with a rotating speed of at least 0.5 Hz with respect to each axis, comprises a base, a support, mounted on the base and being rotatable relative to the base, and a deflector for deflecting the first measuring beam and returning parts of the measurement beam, the deflector being mounted on the support and being rotatable relative to the support, is configured for continuously rotating the support relative to the base around the first axis, in particular with a rotating speed of 1 Hz, and continuously rotating the deflector relative to the support around the second axis, in particular with a rotating speed of 50 Hz, comprises an angle encoder unit configured for determining angle data representing an orientation of the first measuring beam relative to the first and second axes.

3. The system according to claim 1, wherein in the course of generating the first measuring data:

two-dimensional image data of the first detection range are captured continuously by the at least first camera, three-dimensional point-cloud data of the first detection range are captured continuously with the first LiDAR sensor module, and the first measuring unit is configured to link the captured image data and point-cloud data to the pose at which they are captured.

4. The system according to claim 3, wherein the computing unit is configured to identify an obstacle or a person within the first detection range based on the two-dimensional image data or on the three-dimensional point-cloud data, wherein an identified obstacle is carried out by Template Matching.

5. The system according to claim 3, wherein the computing unit is configured to execute at least one of:

a SLAM functionality using at least one of the two-dimensional image data or the three-dimensional point-cloud data for simultaneous localization and mapping, or a pose and trajectory determination functionality for continuously determining a pose and a trajectory of the first measuring unit based on the two-dimensional image data and/or on the three-dimensional point-cloud data.

6. The system according to claim 1, wherein in the course of generating the first measuring data:

the computing unit is configured to continuously generate localization data while the first measuring unit is moved and to track the pose of the first measuring unit and therewith the pose of the road construction machine based on the localization data, particularly in 6 degrees of freedom.

7. A system for positioning of a road construction machine of the type paver, or milling machine, surface miner, recycler or soil stabilizer, the system comprises:

a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, several markers, a data memory, wherein the data memory has stored:

a 3D design model referenced with respect to a 3D construction site coordinate system, and information about a known absolute reference of the several markers in the 3D construction site coordinate system, a computing unit, wherein the computing unit is configured for:

identification of the several markers within the first measuring data and determination of relative positions of the several markers within the first detection range within the first measuring data, determination of a pose of the first measuring unit and therewith the pose, particularly in six degrees of freedom, of the road construction machine in the 3D construction site coordinate system based on the determined relative positions of the several markers and the stored information about the known absolute reference of the several markers, and deriving steering commands for the road construction machine so as to work in accordance with the 3D design model, wherein, as the road construction machine and thus also the first detection range moves forward in accordance with the 3D design model, several further markers, which have not been identified within the first measuring data so far, appear in the first detection range, wherein the computing unit is configured for:

identification of the several further markers and some still identified markers of the several markers within the first measuring data and determination of relative positions of the several further markers within the moved first detection range within the first measuring data, deriving information about a known absolute reference of the several further markers in the 3D construction site coordinate system as new absolute reference in the 3D construction site coordinate system and storing the new absolute reference as new information in the data memory, wherein the step of determination of the pose of the first measuring unit and therewith the pose of the road construction machine in the 3D construction site coordinate system is further based on the determined relative positions of the several further markers and the stored new information about the known new absolute reference.

8. The system according to claim 1, wherein:

the first measuring unit is arranged at a first location of the road construction machine, the system further comprises a second measuring unit arranged at a second location of the road construction machine, the second measuring unit is configured for generating second measuring data in a second detection range and comprising at least a second camera and a second LiDAR sensor module, a relative position, in particular a relative pose, between the first and second measuring unit is predetermined or determinable, wherein the computing unit is configured for generating combined measuring data based on the first measuring data, the second measuring data, and a current relative position, in particular a current relative pose, between the first and second measuring unit.

9. The system according to claim 1, wherein the several markers are retroreflectors, wherein the retroreflectors are configured as at least one of:

at least one triple prism, at least one spherical reflector, retroreflective foil, reflective target mark, microprism array, microprism array consisting of plastic, microprism array consisting of glass.

10. The system according to claim 1, wherein the several markers are features in a construction site comprising at least one of: trees, rocks, poles, and buildings.

11. The system according to claim 1, the system further comprising two GNSS receivers for receiving signals from navigation satellites positioned on the road construction machine fixed and in known relationship with respect to one another.

12. A system for positioning of a road construction machine of the type paver, or milling machine, surface miner, recycler or soil stabilizer, the system comprises:

a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, several markers, a data memory, wherein the data memory has stored:

a 3D design model referenced with respect to a 3D construction site coordinate system, and information about a known absolute reference of the several markers in the 3D construction site coordinate system, a computing unit, wherein the computing unit is configured for:

identification of the several markers within the first measuring data and determination of relative positions of the several markers within the first detection range within the first measuring data, determination of a pose of the first measuring unit and therewith the pose, particularly in six degrees of freedom, of the road construction machine in the 3D construction site coordinate system based on the determined relative positions of the several markers and the stored information about the known absolute reference of the several markers, and deriving steering commands for the road construction machine so as to work in accordance with the 3D design model, and two GNSS receivers for receiving signals from navigation satellites positioned on the road construction machine fixed and in known relationship with respect to one another, wherein the first measuring unit is arranged on the road construction machine in a predefined position with respect to the GNSS receivers, and the computing unit is configured for using the signals to generate direction vectors and for deriving the steering commands for the road construction machine so as to work in accordance with the 3D design model based on the direction vectors.

13. A system for positioning of a road construction machine of the type paver, or milling machine, surface miner, recycler or soil stabilizer, the system comprises:

a first measuring unit configured for continuously generating first measuring data in a first detection range during a movement of the road construction machine and comprising at least a first camera and a first LiDAR sensor module, wherein camera and LiDAR data are recorded covering the first detection range with minimum repetition rate and minimum resolution, several markers, a data memory, wherein the data memory has stored:

a 3D design model referenced with respect to a 3D construction site coordinate system, and information about a known absolute reference of the several markers in the 3D construction site coordinate system, a computing unit, wherein the computing unit is configured for:

identification of the several markers within the first measuring data and determination of relative positions of the several markers within the first detection range within the first measuring data, determination of a pose of the first measuring unit and therewith the pose, particularly in six degrees of freedom, of the road construction machine in the 3D construction site coordinate system based on the determined relative positions of the several markers and the stored information about the known absolute reference of the several markers, and deriving steering commands for the road construction machine so as to work in accordance with the 3D design model, the system further comprising several mobile markers configured to be attached to at least one vehicle at known positions, wherein the at least one vehicle is moving ahead and/or behind the road construction machine, such that the several mobile markers are within one of the first or further detection ranges of the first or further measuring units, and a sending unit configured to send steering commands to the at least one vehicle such that the road construction machine and the at least one vehicle being capable of travelling in formation, wherein the computing unit is configured for:

identification of the several mobile markers within one of the first or further measuring data and determination of relative positions of the several mobile markers within one of the first or further detection ranges within the first or further measuring data, determination of a pose, particularly in six degrees of freedom, of the at least one vehicle in the 3D construction site coordinate system based on the determined relative positions of the several mobile markers and the pose of one of the first or further measuring units, deriving further steering commands for the at least one vehicle so as to work in accordance with the 3D design model, transmitting the further steering commands to the sending unit.

14. The system according to claim 1, wherein the road construction machine is an asphalt paver, concrete paver, or milling machine.

15. The system according to claim 1, wherein the road construction machine is a trimmer, surface miner, recycler or soil stabilizer.

* * * * *